US007861779B2

(12) United States Patent
Vestavik

(10) Patent No.: US 7,861,779 B2
(45) Date of Patent: Jan. 4, 2011

(54) METHOD AND DEVICE FOR ESTABLISHING AN UNDERGROUND WELL

(75) Inventor: Ola Michael Vestavik, Hafrsjord (NO)

(73) Assignee: Reelwell, AS, Stavanger (NO)

( * ) Notice: Subject to any disclaimer, the term of this patent is extended or adjusted under 35 U.S.C. 154(b) by 147 days.

(21) Appl. No.: 10/592,180

(22) PCT Filed: Mar. 7, 2005

(86) PCT No.: PCT/NO2005/000082

§ 371 (c)(1),
(2), (4) Date: Oct. 18, 2006

(87) PCT Pub. No.: WO2005/085580

PCT Pub. Date: Sep. 15, 2005

(65) Prior Publication Data

US 2007/0169943 A1 Jul. 26, 2007

(30) Foreign Application Priority Data

Mar. 8, 2004 (NO) ..... 20040993

(51) Int. Cl.
*E21B 29/00* (2006.01)
*E21B 7/20* (2006.01)
*E21B 43/10* (2006.01)

(52) U.S. Cl. ..... 166/277; 166/207; 166/380; 175/171

(58) Field of Classification Search ..... 166/207, 166/380, 277; 175/171
See application file for complete search history.

(56) References Cited

U.S. PATENT DOCUMENTS 4,121,659 A * 10/1978 Taylor ..... 166/129
4,424,859 A * 1/1984 Sims et al. ..... 166/67
4,694,916 A * 9/1987 Ford ..... 175/249
4,765,405 A * 8/1988 Clark ..... 166/186
5,992,468 A * 11/1999 Dwiggins ..... 138/108
6,543,552 B1 * 4/2003 Metcalfe et al. ..... 175/57
7,234,542 B2 * 6/2007 Vail, III ..... 175/57
7,281,588 B2 * 10/2007 Shampine et al. ..... 166/382
7,370,707 B2 * 5/2008 McDaniel et al. ..... 166/380
2002/0060078 A1 5/2002 Cook et al.
2003/0106688 A1 6/2003 Saugier
2003/0155156 A1 * 8/2003 Livingstone ..... 175/57

(Continued)

FOREIGN PATENT DOCUMENTS

CA 2401813 3/2004

(Continued)

OTHER PUBLICATIONS

Written Opinion, Jul. 21, 2005.

*Primary Examiner*—Jennifer H Gay
(74) *Attorney, Agent, or Firm*—GableGotwals

(57) ABSTRACT

A method and a device for establishing an underground borehole (10) and setting a casing (6) in the borehole (10), wherein the running tool (1) including a drilling tool (14), an expandable casing (6), an expansion tool (32) and a packer (30) which is arranged to seal against the wall of the borehole (10), is placed at the bottom of the borehole (10), whereupon the borehole (10) is drilled to the necessary length in order then to set the expandable casing (6), and in subsequent operations the casing is reinforced and a completion string is run, having built-in cables for downhole control and monitoring.

28 Claims, 7 Drawing Sheets

U.S. PATENT DOCUMENTS

| | | | | |
|---|---|---|---|---|
| 2004/0104052 | A1* | 6/2004 | Livingstone | 175/61 |
| 2005/0178586 | A1* | 8/2005 | Livingstone | 175/317 |
| 2008/0128140 | A1* | 6/2008 | Giroux et al. | 166/381 |

FOREIGN PATENT DOCUMENTS

| | | | |
|---|---|---|---|
| EP | 1006260 | A2 | 6/2000 |
| GB | 2357101 | | 6/2001 |
| WO | WO 99/35368 | A1 | 7/1999 |
| WO | WO 00/037771 | | 6/2000 |
| WO | WO 03/078790 | | 9/2003 |
| WO | WO 2005/052304 | A1 | 6/2005 |
| WO | WO 2005/061835 | A1 | 7/2005 |

* cited by examiner

METHOD AND DEVICE FOR ESTABLISHING AN UNDERGROUND WELL

CROSS-REFERENCE TO PENDING APPLICATIONS

This application is based on PCT Patent Application No. NO2005/000082, filed on Mar. 7, 2005, which was based on Norwegian Patent Application No. 20040993, filed on Mar. 8, 2004.

This invention relates to a method for establishing an underground well, in particular a petroleum well. By establishing is meant to drill, completely or partially, a hole and further to line the hole, so that the wall of the hole is sealed, and to place a completion string in the well for production or injection. If a hole exists from earlier, the method may also be used in order to line the hole or in order to place a completion string, whereby the possibility for downhole measuring and control is improved.

More particularly, the invention relates to a method, in which a lining is transported into the borehole together with the drilling tool and positioned in the borehole before the drilling tool is pulled to the surface. The method is particularly suitable for use in so-called deviated drilling, in which the direction of the borehole may deviate considerably from a vertical direction.

In addition, the method includes the positioning of a completion string, maybe with integrated electric or optical cables, and possibly with sensors and actuators for completion of the well for production or injection. The invention also includes a device for practicing the method.

In the description, upper and lower refer to relative positions when the tool is in a vertical borehole.

When drilling an underground deviating borehole, it can be difficult to have sufficient thrust transferred to a drill bit. The reason may be that a substantial part of the weight of the drill string and the weight of possible drill collars placed above the drill bit is absorbed by friction between the borehole wall and the drill string. It has turned out that to move casing, for example, forward in a deviation is borehole can be difficult when relatively long and approximately horizontal borehole portions are involved. The reason for this is the considerable frictional forces, which arise between the borehole and the casing as the casing is being moved, and which have to be overcome.

Norwegian patent 179261 deals with a device, in which there is arranged, above the drill bit, a piston sealingly movable against the borehole. The fluid pressure in the borehole exerts a force on the piston, which is arranged to move the drill bit into the borehole. The document describes to a limited degree the lining and completion of boreholes.

The invention has as its object to remedy the drawbacks of the prior art.

The object is realized in accordance with the invention through the features specified in the description below and in the following claims.

A lower tool assembly includes a drilling tool of a kind known per se, which is arranged to drill a borehole with a larger diameter than the opening through which the drilling tool can be moved. The lower tool assembly also includes a driving motor for the drilling tool, necessary valves and instruments for controlling the drilling tool. It is advantageous also to provide the lower tool assembly with logging tools for measuring positions, pressure and formation parameters, and a blow-out preventer (BOP) mounted on the return flow line for pressure control and in order to prevent a blow-out.

The lower tool assembly is connected to at least two pipe conduits extending to the surface. A drill string in the form of a double coiled tubing can be used with advantage, in which a coiled tubing extends inside an outer coiled tubing of a greater dimension, or there may be a dual channel pipe of some other type or two coiled tubings side by side. A drill string of this kind has at least two separate conduits.

A drill string in the form of a double coiled tubing is chosen as an example, but the method and device according to the invention are also applicable for joined coilable pipes and joined pipes which are not coiled.

The drill string extends from the lower tool assembly up to the surface, the first coiled tubing conduit being used for pumping down drilling fluid whereas a second coiled tubing conduit, maybe the inner conduit, is used for returning drilling fluid and cuttings.

A casing, which is connected by its lower portion to the lower tool assembly, encircles the coiled tubing along its length from the lower tool assembly upwards. The casing may favourably be of a deformable and expandable kind by being arranged to be plastically deformed and expanded both before and after being positioned in the borehole. From here on, the casing will be referred to as the expandable casing, even though, in one form of method an embodiment may be chosen, in which this pipe is not expanded.

An upper tool assembly encircles, in a movable and sealing manner, the coiled tubing and is connected to the upper portion of the expandable casing. The upper tool assembly includes a displaceable packer sealing against the borehole wall. This packer may possibly be expandable, it being arranged to be expanded to seal against the borehole wall controlled from the surface, for example by means of back pressure on the packer. This packer may also have a built-in controllable valve, which can allow flow past packers in particular situation, for example when the drilling equipment is lowered into the well.

The upper tool assembly may also include a rolling anchor, which is arranged to absorb torques, for example from the drilling tool. Further, the upper tool assembly may include an expansion mandrel for the expansion of the casing. This expansion mandrel may with advantage be provided with wheels or other forms of rotating devices arranged to reduce friction and facilitate expansion of the expandable casing. Said wheels may be used entirely or partially as a rolling anchor in order to absorb the above-mentioned torques.

A running tool according to the invention thus includes a lower and an upper tool assembly, a casing and two pipe conduits extending from the lower tool assembly up to the surface.

The method for drilling and setting a casing in the borehole includes lowering the running tool to the bottom of the borehole, where a casing has already been set and cemented. The fluid pressure in the annulus above the upper tool assembly acts on the running tool, causing the drilling tool to be pressed against the bottom of the borehole, as the movable sealing packer of the upper tool assembly seals against the set casing.

Drilling fluid is pumped from the surface through the first pipe conduit down to the driving motor of the drilling tool, which is preferably located in the lower tool assembly. It is possible, however, for the driving motor to be placed in the upper tool assembly. The torque of the drilling tool may favourably be absorbed via the expandable casing by friction against the bore wall or by the rolling anchor, which is preferably located in the upper tool assembly.

Return fluid and cuttings flow from the bottom of the hole via the second pipe conduit to the surface. The inlet into the second pipe conduit may be either at the centre of the drill bit and be directed in pipes through the lower tool assembly, or it may be in an annulus behind the drill bit and be directed through one or more channels and from there into the second pipe conduit. When the return is through the centre of the drill bit, this will also enable continuous coring with return of the core to the surface in the liquid flow up through the return conduit during drilling.

It is also possible to flush and place liquid externally to the expandable casing. This may also be carried out by using controllable valves in the lower tool assembly. Here may be placed valves, which can be controlled from the surface. These valves may direct liquid which is pumped from the surface, to flow via the lower tool assembly and back to the upper tool assembly in an annulus between the coiled tubing and the expandable casing, in order then to flow back down to the bottom of the hole on the outside of the expandable casing. In this way this annulus may periodically or continuously be washed clean of particles and possible gas. Further it is possible to place cementation mass in the annulus, which may subsequently be placed outside the expandable casing, maybe in connection with expansion of the pipe.

As the drilling tool extends the borehole, the running tool is moved downwards until the upper portion of the expandable casing approaches the lower portion of the set casing. If it is chosen to expand the casing after drilling is finished, this may be done with the following procedure: By increasing the pressure in the borehole above the upper tool assembly to a predetermined level, the upper tool assembly is released from the expanding casing, after which the expansion mandrel is urged through the expanding casing. The expanding casing is thereby expanded to its predetermined dimension.

Before a possible expansion of the casing, cementation mass, which is pumped down from the surface, or which is most preferably located in the expandable casing during the drilling operation, can be directed into the annulus between the expandable casing and the borehole wall.

During the expansion the drill string may favourably be kept tightened in order to provide extra compression on the expanding casing.

After a possible expansion, the lower tool string will be disconnected from the lower portion of the expanding pipe, after which the running tool may be pulled out of the borehole in order for it to be fitted with a new expandable casing.

Preferably, the process is repeated several times with desired lengths of casing until the desired drilling depth has been reached. There are no or just insignificant differences in diameter between the expanded lengths of casing.

For drilling in a petroleum reservoir, casing may in some well portions be replaced with flow-through sand screens of an expandable or non-expandable kind.

Energy and control signals may be transmitted to the device by means of methods known per se, like downhole telemetry and cable along the drill string.

The motor for driving the drill bit is supplied with energy from the drill string, either via drilling fluid, which is pumped from the surface, electrical energy through the drill string, or chemically by fuel being carried down to the motor from the surface, possibly through separate channels in the drill string.

The drill string, casing and completion string may be of a conventional kind made of steel of different qualities, or they may be made of other materials, for example of a light metal like aluminium, possibly in combination with an antiwear coating and electrical insulation coating on the inside and/or on the outside.

Using new materials in this way enables the drill string to be lighter. The drill string may be made approximately weightless in that, as circulation liquid inside the drill string, there is used a liquid with a lower density than the liquid located externally to the double drill string. In the same way as the drill string, the casing and the completion string may be a complete coilable pipe length, joined coilable pipes or joined pipes, which are not coiled.

In an alternative embodiment, the transmission of electrical power and transmission of signals may be effected in that at least one pipe in the drill string has an electrical insulating material applied on one or both sides, whereby at least one pipe is electrically insulated from the earth potential. Thereby it will be possible to send considerable amounts of electrical energy with relatively little loss through the insulated pipe due to the relatively large metallic cross-sectional area of the pipe. The good supply of electrical energy may favourably be used for the transmission of both effect and signals, as for example for driving a downhole electric motor for the rotation and operation of the drill bit. The electric conductor can also be used for driving a downhole electric pump for pressure control of return fluid, and for controlling downhole actuators, data acquisition and telemetry to the surface.

Electric and/or optical conductors of relatively small cross-sections for signal transmission between the surface and sensors or actuators placed downhole in the drill string may be placed in the insulating material. These signal transmission cables may possibly be protected against wear, for example by lying protected in a reinforced composite material.

Permanent pipe strings like casing and completion strings can also be used according to the method described above for communication with downhole sensors and actuators with cables built into a protective insulating material on the inside or on the outside. Such permanent pipe strings will have particular advantages, for example in the recovery of petroleum, in which they may also easily be used for downhole monitoring and control of production or injection. Involved here may be a pipe string of the expanding casing kind which is forced out and seals against the existing lining of the well, thereby also helping to ensure tightness and also to increase the strength of the lining of the well. It may also be a string of the same kind, but which is not expanded and which may be fixed by cementation in the borehole, in this way becoming part of the lining in the well.

Together with downhole sensors and actuators the above-mentioned string, with cables built into a protective insulating material on the inside or on the outside, may be pullable and be set in the well without cementation. This string, possibly in combination with a downhole packer element, will thereby make up a pullable completion string which enables monitoring and control of the production and injection in different zones.

It is advantageous to provide the inside of the external drill pipe with an electrical insulating material, in which signal cables are extended. In this way there may be provided in the drill string a possibility for electrical communication, and for the outer pipe of the drill string to be used subsequently as a so-called completion string.

The method and the device according to the invention offer advantages through efficient establishing of wells, as regards both on-land wells and subsea wells. Particular advantages are achieved in establishing subsea wells because the riser is built into the drill string, that is to say in principle it is not imperative to have an outer pipe round the drill string, or an extra pump device for return transport of the drilling fluid from the sea floor to the sea surface. This means particular advantages in great sea depths because of weight saving.

The method and the device also offer advantages through increased safety during drilling, as an extra barrier can be established for well control. The drilling fluid above the upper tool assembly may favourably be a so-called kill fluid, that is to say it has a specific gravity which is chosen to be such that the pressure within the well will always be greater than the pore pressure in the surrounding formation and therefore represents a well control barrier. A BOP (Blow-Out Preventer) at the top of the well is another form of well control barrier.

According to this method, a novel well control barrier is formed by the movable packer of the upper tool assembly in combination with a preferably fail-safe valve on the return flow pipe, said valve being integrated in the lower tool assembly and controllable from the surface. These elements represent an additional barrier for preventing uncontrolled flow of formation fluid into the well in given situations. These elements also offer increased safety and control, for example in under-balanced drilling, as it enables controlled production from the well during drilling.

On the background of what has been mentioned above, the drilling fluid, which is circulated, may be designed with a very low density without this making the drilling safety suffer. The method and the device according to the invention thus enable improved monitoring and control of the pressure within the open hole of the well.

In connection with the use of a light-weight drill string with buoyancy, as described above, this method permits drilling of particularly far-reaching and deep holes. This may give more efficient draining of fields for the recovery of petroleum. It may also be advantageous in other application areas, as for example in connection with the recovery of geothermal energy. An approximately weightless drill string will also allow a drilling ship to be less demanding as to accurate positioning and response time on drift, and enables simplified heave compensation in the drilling of a subsea well in that heave is compensated through flexing of the drill string.

For a subsea well the drill string may extend through the open sea, or it may be directed from the sea floor to the surface through a guide pipe, which may be filled with water or drilling fluid of a desired density. This guide pipe itself may also have integrated floating elements, so that it does not itself represent any great load in the form of forces exerted on the drilling vessel.

In what follows is described a non-limiting example of a preferred method and embodiment visualized in the accompanying drawings, in which.

Figure 1:
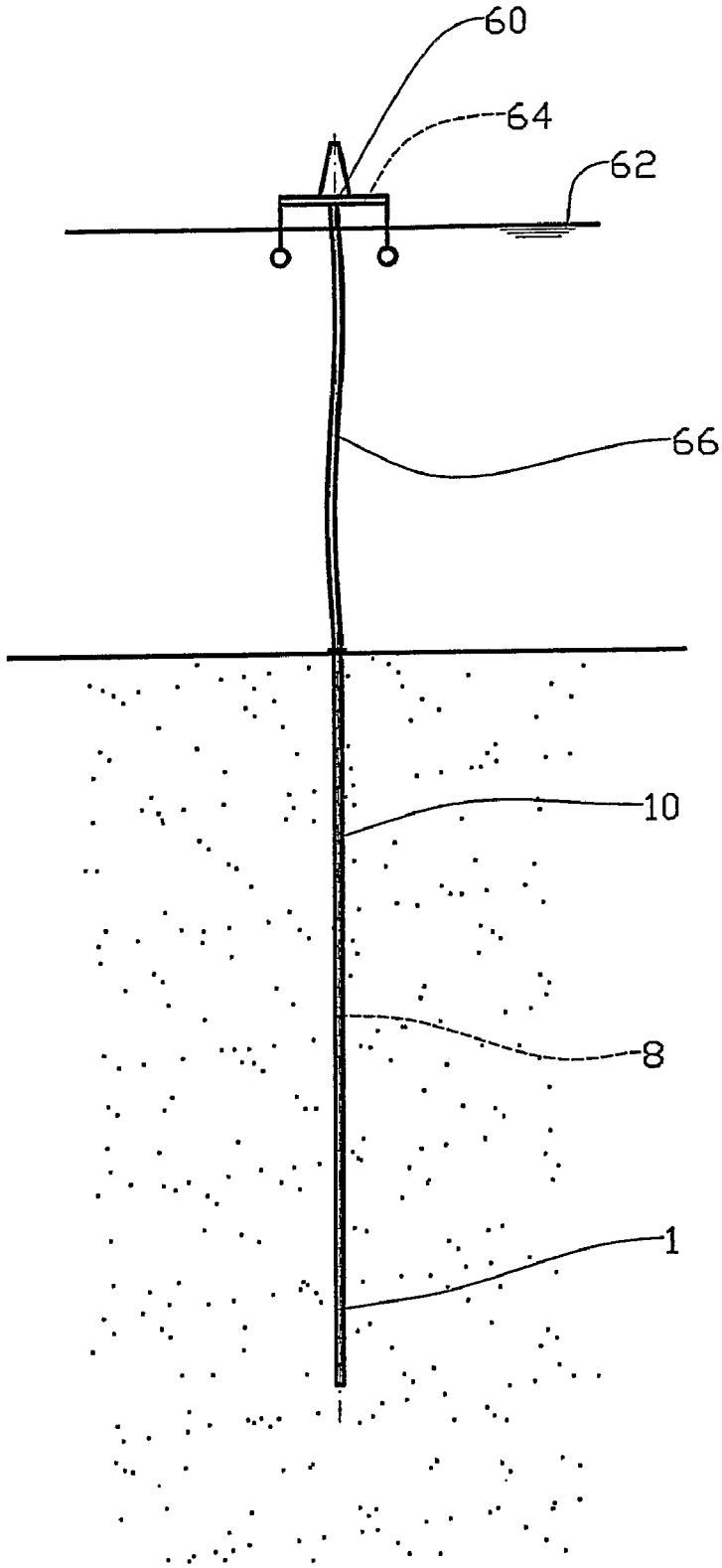
FIG. 1 shows schematically a well, which is being established by means of a vessel located on the sea surface.

In the drawings the reference numeral 1 identifies a running tool including a lower tool assembly 2, an upper tool assembly 4, an expandable casing 6 extending between the upper and lower tool assemblies 4, 2, and a double coiled tubing 8 extending from the lower tool assembly 2 to the surface.

The running tool 1 is placed in a borehole 10, which is provided with a casing 12.

Figure 5:
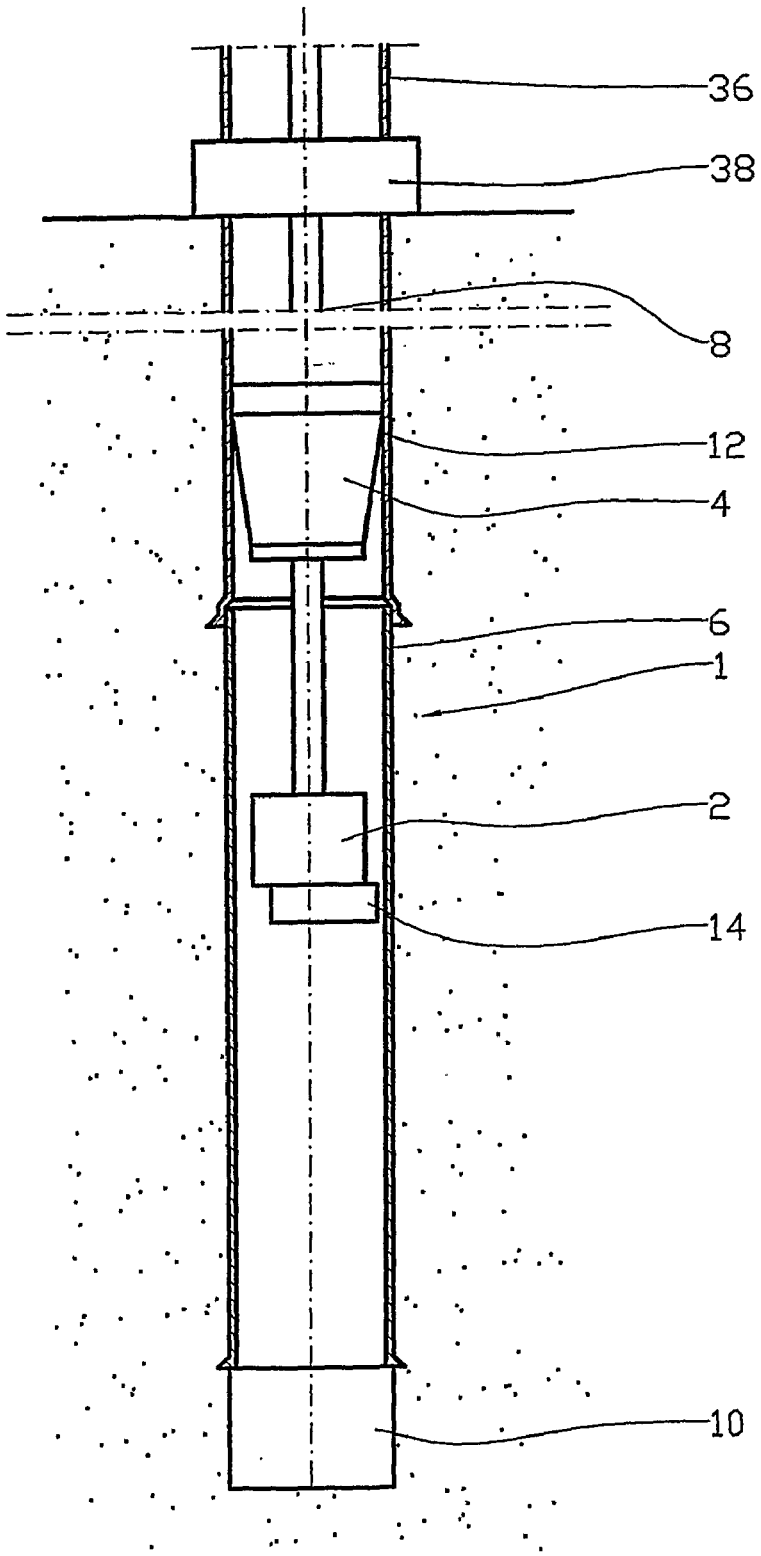
FIG. 5 shows schematically the expandable casing as expansion is completed, the lower tool assembly being pulled up through the expanded casing.
Figure 6:
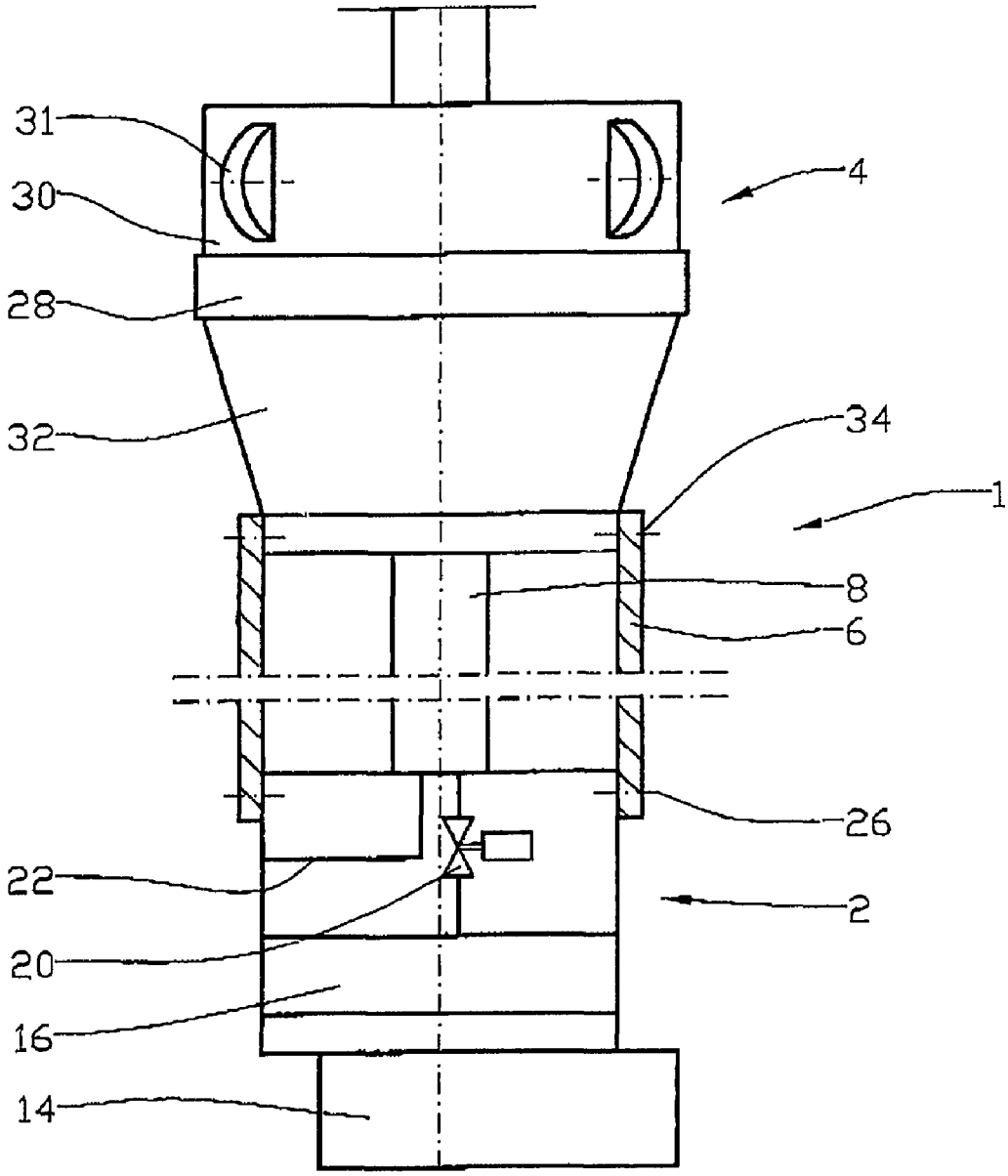
FIG. 6 shows schematically the running tool on a larger scale.
Figure 7:
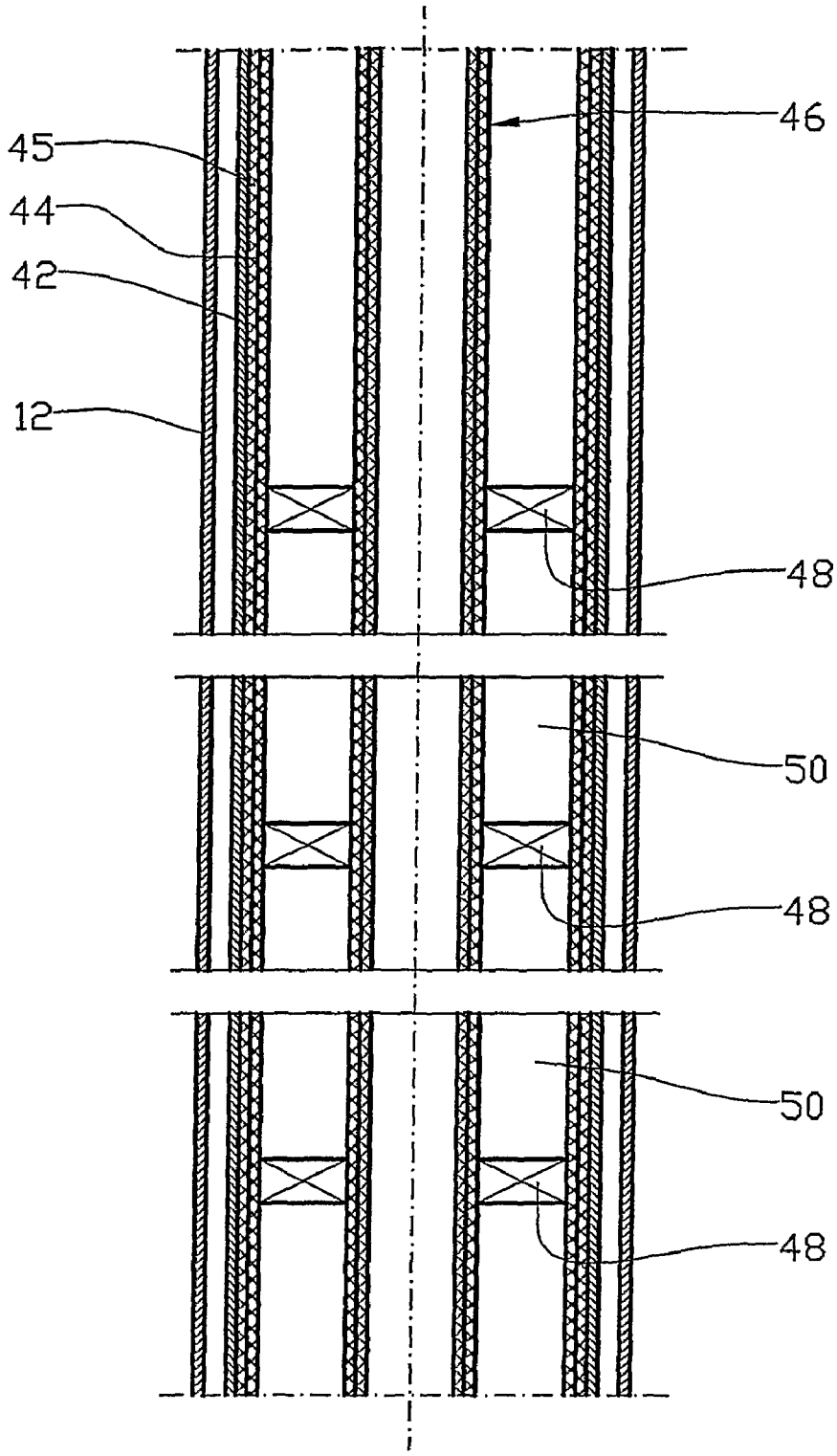
FIG. 7 shows a well, in which there are placed a reinforcing casing and a completion string.

The lower tool assembly 2, see FIG. 5, includes a drilling tool 14 of a kind known per se, which is of such configuration that it may be moved through an opening of a smaller diameter than the diameter of the borehole 10 which the drilling tool 14 is arranged to drill. A motor 16 drives the drilling tool 14, see FIG. 6.

Drilling fluid and cuttings can flow to the surface via a return inlet 22 in the lower tool assembly 2 connected to a second pipe conduit 24 of the double-coiled tubing 8. Alternatively, the return inlet 22 may be at the centre of the drill bit (not shown in the figure) in order also to transport cores 25 from the bottom of the hole directly into the second pipe conduit 24.

The lower tool assembly 2 is releasably connected to the lower portion of the expanding casing 6, for example by means of lower shear pins 26.

The double-coiled tubing 8 extends sealingly and movably through the upper tool assembly 4. In this preferred embodiment the upper tool assembly 4 includes a movable packer 28 sealing against the casing 12, a rolling anchor 30 with rollers 31 and an expansion tool 32. The components 28, 30 and 32 are each known per se and are not described in further detail.

The upper tool assembly 4 is releasably connected to the upper end portion of the expanding casing 6, for example by means of upper shear pins 34.

After the running tool 1 has been assembled on the surface, it is sluiced into the borehole 10 possibly through a riser 36 and wellhead valves 38. Subsequently the running tool 1 may be moved down into the borehole by gravity forces or by fluid being pumped into the borehole 10 above the upper tool assembly 4, the packer 28 sealing against the casing, and by the fluid pressure acting on the upward-facing area of the tool assembly 4. The fluid located below the running tool 1 can be drained to the surface through the second pipe conduit 24 of the double-coiled tubing 8. The draining from the running tool 1 to the surface can be improved by means of a not shown, preferably electrically driven booster pump in the lower tool assembly 2.

Figure 2:
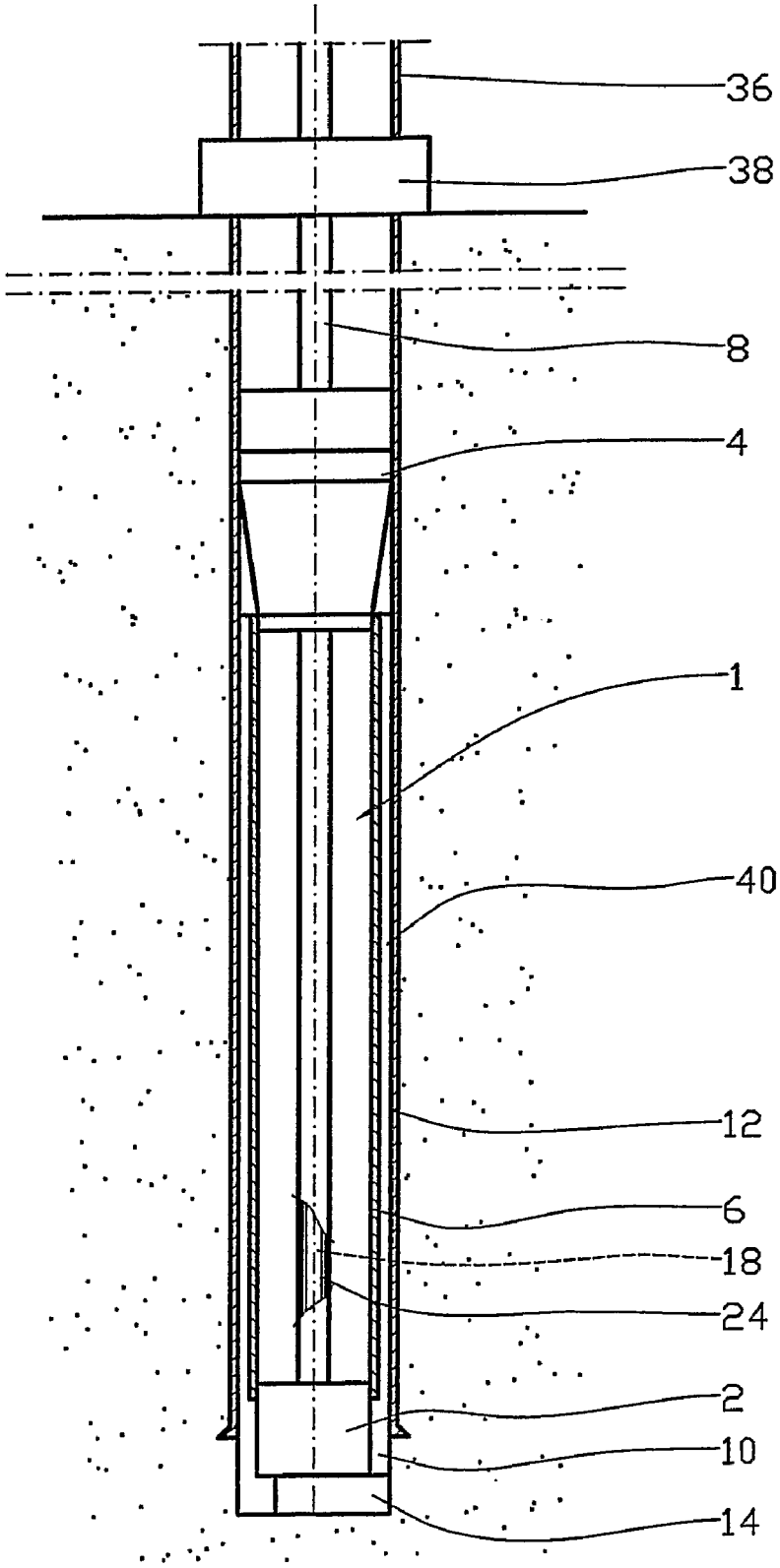
FIG. 2 shows schematically, and on a larger scale, a running tool, which is placed at the lower end portion of a borehole.
Figure 3:
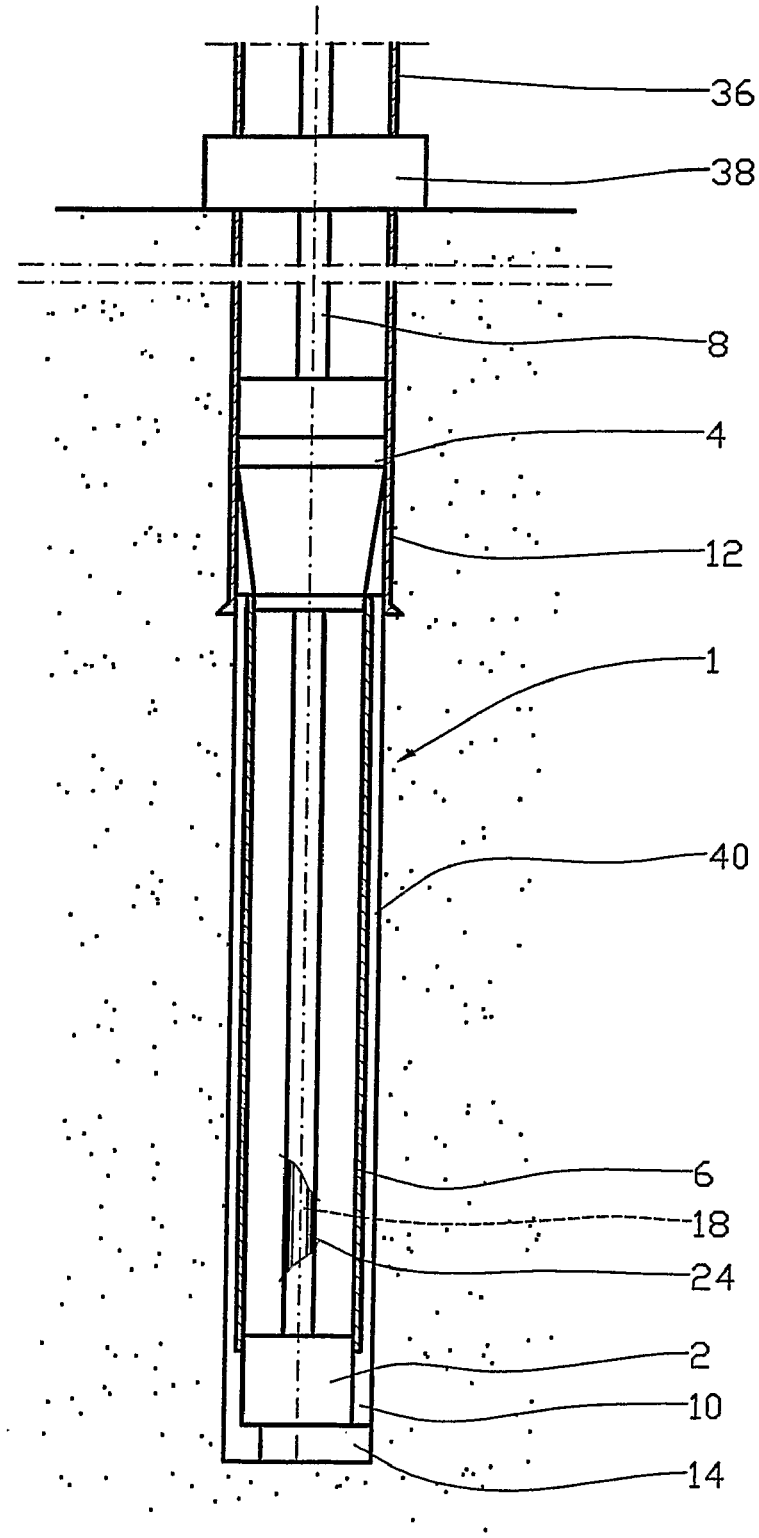
FIG. 3 shows schematically the running tool after the borehole has been drilled further, so that the upper end portion of the expanding casing corresponds with the lower end portion of a previously set casing.

When the drilling tool 14 of the running tool 1 hits the bottom of the borehole 10, see FIG. 2, the drilling tool 14 is set in a manner known per se to drill at a desired diameter, after which the motor 16 is started. The torque of the drilling tool 14 is absorbed via the expanding casing 6 by the rolling anchor 30 of the upper tool assembly 4.

The feed pressure of the drilling tool 14 against the bottom of the borehole 10 can be adjusted by adjusting the fluid pressure against the topside of the upper tool assembly 4. This feed pressure can also be adjusted by changing the density or flow rate of the circulating drilling fluid, or it can be adjusted by means of a not shown pump, as described above.

After a distance corresponding to the length of the expandable casing 6 has been drilled, so that the end portion of the expanding casing 6 corresponds with or approaches the lower end portion of the casing 12, see FIG. 2, the drilling is stopped.

If desirable, the expandable casing 6 may be provided internally with cementation mass, which is forced, during this part of the operation, into an annulus 40 between the expandable casing 6 and the borehole 10, or the annulus 40 may be flushed.

The pressure of the fluid above the upper tool assembly 4 is increased, so that the upper shear pins 34 break, after which the expansion tool 32 is moved down the expandable casing 6. The expandable casing 6 is thereby given a desired, expanded diameter.

As the expansion tool hits the lower tool assembly 2, the lower shear pins 26 break, whereby the lower tool assembly 2 is released from the expandable casing 6. The running tool 1 with the exception of the expandable casing 6, is then pulled up from the borehole 10, see FIG. 5.

Figure 4:
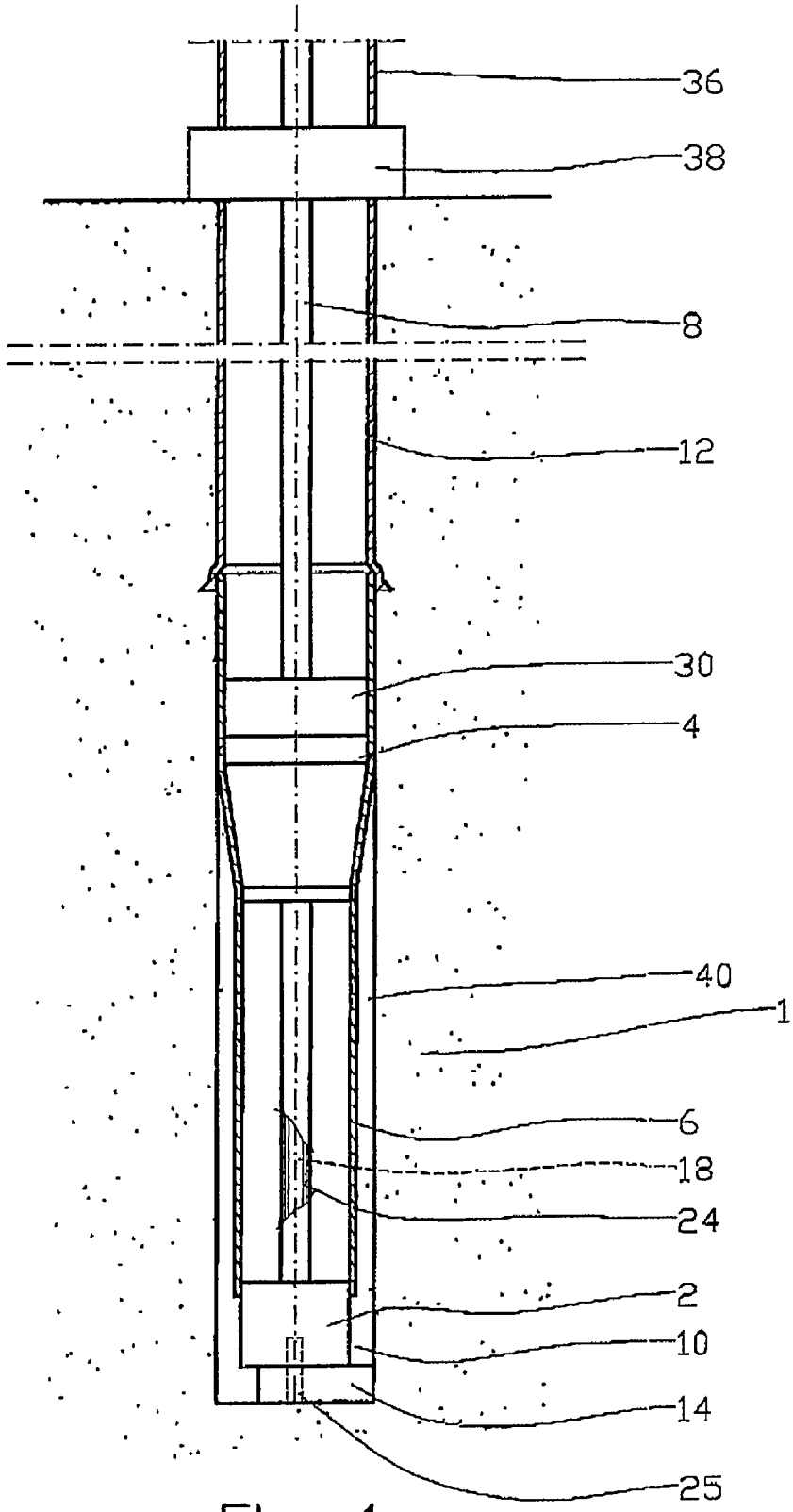
FIG. 4 shows schematically the running tool as the expandable casing is expanded to its expanded diameter.

In FIG. 4 is shown that the entire upper tool assembly 4 is moved into the expandable casing 6 together with the expansion tool 32. In an alternative embodiment not shown, parts of the upper tool assembly 4, for example the rolling anchor 30, may be left at the upper portion of the expandable casing during the expansion operation.

After the drilling to the desired drilling target has been completed, one or repeated actions of reinforcement of the casing 12 in the well may be carried out by expansion of a reinforcement casing 42, which may form the entire length of the well or parts thereof, against the casing 12 already standing in the borehole. Alternatively, the reinforcement casing 42 can be cemented to the casing 12. This reinforcement casing 42 which makes the casing 12 be reinforced, may favourably be provided with built-in electrical or optical cables 44, and not shown downhole sensors and actuators for monitoring and controlling production or injection. This reinforcing operation may be repeated in order to increase the strength of the lining of the borehole 10 to the desired level.

After the lining of the borehole 10 has been completed, there is placed, preferably when production wells are involved, a pullable completion string 46 in the borehole 10. This completion string 46 may, in the same was as the reinforcement casing described above, be provided with built-in electrical or optical cables 44, and not shown downhole sensors and actuators.

The completion string 46 is preferably provided with at least one downhole packer 48 which is arranged to seal against the casing 12, possibly the reinforcement casing 42, in order thereby to isolate the annulus between the completion string 46 and the casing 12 in at least one well zone 50.

If it is desirable to drain from or inject into several well zones 50 simultaneously, it is advantageous for the completion string 46 to be provided with two or more conduits, in the same way as for the drill string 8.

The establishing of the borehole 10 is carried out by means of a vessel 60 on the sea surface 62; see FIG. 1, the vessel 60 being provided with drilling equipment 64. The drill string 8 is typically reeled onto a drum, not shown, on the vessel 60 before being moved down into the borehole 10.

The drill string 8 can be disposed freely in the sea, or it may be encapsulated in a riser 66. The riser 66 may be provided with floating elements, not shown.

The invention claimed is:

1. A method for establishing an underground borehole and setting an expandable casing below a casing, said method comprising:

providing a running tool including a lower tool assembly with a drilling tool, an expandable casing, an expansion tool, a packer and at least two pipe conduits running from the lower tool assembly and to the surface;

placing the running tool at the bottom of the borehole;

drilling to the necessary length while the packer is sealing against the casing;

setting the expandable casing; and draining a fluid in the borehole below the running tool to a surface through one of the pipe conduits.

2. A method in accordance in claim 1, further comprising pulling the running tool with the exception of the expandable casing out of the borehole after the expandable casing has been set.

3. A method in accordance with claim 1, further comprising moving the running tool forward to the bottom of the borehole using fluid pressure in the borehole above the running tool.

4. A method in accordance with claim 1, further comprising draining the fluid in the borehole below the running tool to the surface through one of the pipe conduits assisted by a downhole pump.

5. A method in accordance with claim 1, further comprising pumping a cementation mass into an annulus between the expandable casing and the borehole.

6. A method in accordance with claim 1, further comprising moving a reinforcement casing into the casing and connecting the reinforcement casing to the casing.

7. A method in accordance with claim 6, further comprising connecting the reinforcement casing to the casing by expanding the reinforcement casing into the casing.

8. A method in accordance with claim 6, further comprising connecting the reinforcement casing to the casing by cementation.

9. A method in accordance with claim 1, further comprising making the drill string weightless by circulating a liquid in the drill string, the liquid having a lower density than the liquid on the outside of the drill string.

10. A method in accordance with claim 1, further comprising drilling a cylindrical drill core; and transporting the core to the surface by the liquid flow through a lower tool assembly up through a return conduit in a drill string.

11. A device for a running tool used to drill into earth from a surface and setting an expandable casing below a casing, said device comprising:

a drilling tool, an expandable casing, an expansion tool, at least two pipe conduits running from a lower tool assembly and to the surface and a packer wherein the packer seals against the casing, the drilling tool is releasably connected to a lower portion of the expandable casing, and the expansion tool and packer are releasably connected to an upper portion of the expandable casing, and the running tool is arranged to communicate with the surface through one of the pipe conduits.

12. A device in accordance with claim 11, further comprising a drill string connected to the running tool and the surface.

13. A device in accordance with claim 12, wherein the drill string is made of aluminium.

14. A device in accordance with claim 12, wherein the drill string is reinforced with a fibre composite.

15. A device in accordance with claim 12, further comprising a completion string, wherein the drill string, the expandable casing and the completion string are windable and arranged to be stored on a pipe reel on the surface before being reeled down into the borehole.

16. A device in accordance with claim 12, wherein the running tool is placed on a floating vessel for the drilling of a well in a sea floor, the drill string being extended through an open sea.

17. A device in accordance with claim 12, further comprising a riser having floating elements, wherein the running tool is placed on a floating vessel for the drilling of a well in a sea floor, the drill string being extended through the riser from the sea floor to the vessel.

18. A device in accordance with claim 17, wherein the riser is telescopic and thereby arranged to allow the vessel some drift from its position above the well.

19. A device in accordance with claim 12, the drill string comprising a double coiled tubing.

20. A device in accordance with claim 11, the running tool further comprising a rolling anchor.

21. A device in accordance with claim 11, the expansion tool further comprising rollers arranged to reduce sliding friction and work, at the same time, as a rolling anchor.

22. A device in accordance with claim 11, further comprising the drilling tool is driven by a drilling motor supplied with pressurized fluid from the surface via one of the pipe conduits.

23. A device in accordance with claim 11, further comprising the drilling tool is driven by a drilling motor supplied with electrical energy from the surface via one of the pipe conduits.

24. A device in accordance with claim 11, further comprising at least one of the casing, a pipe conduit of a drill string, or a completion string is electrically insulated from an earth potential by an electrical insulating material and thereby arranged to transmit energy or signals.

25. A device in accordance with claim 24, further comprising a wire disposed in the electrical insulating material.

26. A device in accordance with claim 25, the wire comprising optical wire.

27. A device in accordance with claim 25, the wire comprising electrical wire.

28. A device for a running tool for use in a well casing, said device comprising:

a drilling tool;

an expandable casing; and a packer;

wherein the packer is arranged to seal between the expandable casing and the casing prior to expansion of expandable casing.

* * * * *